US006663512B2

(12) United States Patent
Martin

(10) Patent No.: US 6,663,512 B2
(45) Date of Patent: Dec. 16, 2003

(54) PITCHING COACH

(75) Inventor: Jeffrey M. Martin, Mahomet, IL (US)

(73) Assignee: The Pitching Coach, LLC, Mahomet, IL (US)

( * ) Notice: Subject to any disclaimer, the term of this patent is extended or adjusted under 35 U.S.C. 154(b) by 0 days.

(21) Appl. No.: 10/053,912

(22) Filed: Jan. 24, 2002

(65) Prior Publication Data

US 2003/0139232 A1 Jul. 24, 2003

(51) Int. Cl.[7] ..... A63B 69/00
(52) U.S. Cl. ..... 473/452
(58) Field of Search ..... 473/451, 452, 473/422, 427; 482/40, 102; 124/1, 7, 17, 78, 56, 36

(56) References Cited

U.S. PATENT DOCUMENTS 1,036,024 A * 8/1912 Stone ..... 273/317.7
1,962,087 A * 6/1934 Cone ..... 473/429
2,294,035 A * 8/1942 Kellermann et al. ..... 124/7
3,009,451 A * 11/1961 Zone ..... 124/7
3,138,388 A * 6/1964 Herold ..... 473/276
3,910,249 A * 10/1975 Gustavsson ..... 124/8
4,082,076 A * 4/1978 Perry ..... 124/7
4,175,744 A * 11/1979 Llewellyn ..... 473/149
4,271,813 A * 6/1981 Rowe ..... 124/7
4,784,107 A * 11/1988 Kelly ..... 124/61
4,846,471 A 7/1989 Haysom
4,974,836 A 12/1990 Hirsch
5,000,449 A 3/1991 Weeks
5,269,512 A * 12/1993 Crowson et al. ..... 473/457
5,288,074 A * 2/1994 Scheurer ..... 473/277
5,333,855 A * 8/1994 Silin et al. ..... 473/455
5,553,847 A * 9/1996 Surrency ..... 473/453
5,639,243 A 6/1997 Ryan et al.
6,093,111 A * 7/2000 Senn ..... 473/277
6,129,076 A * 10/2000 Powell et al. ..... 124/7
D460,506 S * 7/2002 Tamminga et al. ..... D21/686
6,505,617 B1 * 1/2003 Neuman ..... 124/7

* cited by examiner

*Primary Examiner*—Paul T. Sewell
*Assistant Examiner*—Mitra Aryanpour
(74) *Attorney, Agent, or Firm*—Knechtel, Demeur & Samlan

(57) ABSTRACT

A pitching apparatus is provided that teaches the fundamental techniques of a desired pitch through the regulation and control of a control arm. The pitching apparatus consists of a mechanical box housing, a control arm, and a control box housing. The mechanical box housing utilizes a vertical axis member, a collar with a cutout, and a latch to position the control arm into a locked position. A light emitting diode sensor and a solenoid coact to release the control arm from the locked position and a spring mechanism moves the control arm into a rest position. The control box housing supports a control panel and is used to regulate and control the mechanics of the mechanical box housing in accordance with the selected pitch that the pitcher would like to learn.

17 Claims, 5 Drawing Sheets

U1
AT9058515
PROGRAM HEADER
J5-1
J5-2
J2-1
J2-2
J2-3
J2-4
J2-5
J2-6
J3-1 S1
J3-2 S2
J3-3 S3
J3-4 SCOM
J3-5 S4 ARM
J3-6 ARM
J4-1 LED1
J4-2 LED2
J4-3 LED3
J4-4 LO BAT LED
J4-5 LED1-3 COM
J4-6 LO BAT LED
ARM IND
J4-8
X1
4.00 MG
JP1
Q1
1N7DD0
U4
ICL7665
U3
LM555
U5
MCP120
U13
LM7805CT
U14
LM7805CT
U2-A
74HC123-A
D1
1N4001
D2
1N4001
+12V
-12V
J1-1
J1-2
+5VT
+5VR
GND

PITCHING COACH

I. FIELD OF THE INVENTION

The present invention relates to a pitching apparatus and, more particularly, to a pitching apparatus that simulates the proper pitching mechanics to effectively teach the fundamental techniques of pitching.

II. DESCRIPTION OF THE PRIOR ART

In baseball, the pitching position is pivotal to the success of any team. This position is, therefore, fielded by the pitcher who has developed proper pitching mechanics, the result of which maximizes performance and reduce injuries which may dramatically affect the success of the team and ultimately the pitcher's career.

There exist a number of baseball pitching training apparatus that focus on different aspects of a pitch. However, a significant problem with these devices is that none focus on the most important aspect of pitching, body positioning, and then combine all the facets integral to a proper pitch into one complete pitching training apparatus.

For example, a baseball pitching apparatus that trains the feet position of the pitcher is seen in U.S. Pat. No. 5,000,449 to Weeks entitled "Baseball Pitching Trainer" which discloses a baseball pitching trainer designed to teach a prospective pitcher the proper pitching stance and body orientation to execute a proper pitch. The trainer comprises a mat having a foot engaging portion, a tee mechanism, and a target. In operation, the pitcher adopts the appropriate stance by placing the pitcher's feet over the foot outlines in the mat. The pitcher may then assume the pitching motion in which the pitching hand grasps the baseball from the top of the tee mechanism. The pitcher completes the pitch by throwing the baseball toward the target with the left foot and right foot landing in the appropriate landing area on the mat. This device, however, has several inherent shortcomings. First, this device only teaches a pitcher the proper foot stance prior to execution of the pitch. As a result, this device does not control or train the proper stride of the pitcher which will cause the pitcher to either overextend the stride or not extend enough while attempting to land on the appropriate landing area. Second, the pitcher is not provided with any further training to actually simulate and execute the remaining fundamentals of the pitch. The pitcher is not provided with any control or training to master the remaining fundamentals of the pitch. Lastly, as the device is devoid of training to simulate and execute a proper pitch, a pitcher is susceptible to improper body positioning throughout the execution of the pitch. Consequently, the pitcher will develop bad habits from mechanical flaws that effectuate poor pitching and, thereby, create vulnerability to injury from the increased body stresses precipitated by the inefficient mechanics.

In another example, a baseball pitching apparatus that trains the pitcher through arm positioning is U.S. Pat. No. 5,639,243 to Ryan et al. entitled "Training Apparatus, Method For Training An Athlete, And Method For Producing A Training Device." This patent discloses a device to train an athlete, such as a baseball player. The device comprises a starting pad, a landing pad, and a target which are spaced along a beam. In operation, the pitcher stands on the starting pad and grips a baseball. The pitcher executes a pitch through a wind up on the starting pad and then strides to the landing pad while throwing the baseball toward the target. This device likewise presents a number of problems to teach the fundamentals of a proper pitch. The device does not have the ability to train the proper positioning and orientation of the pitcher during the wind-up to effectively execute a proper completed pitch. The device does not use a light emitting diode sensor to regulate the training device to control the proper mechanics of the pitch. The device uses a beam within the pitcher's pitching path in which the pitcher transfers from a starting pad to a landing pad during an executed pitch. The beam, however, may be injurious to the pitcher if the pitcher does not have proper balance or positioning during the pitch and, thereby, is unable to accurately transfer from the starting pad to the landing pad. The device teaches the use of a vertical posture guide, or screen, to constrain the athlete's upper torso movements. However, since the upper torso will move where the hips move, the vertical posture guide is inherently useless without a hip stabilizer.

Other examples of apparatus for baseball pitching that trains only the resistance and muscle memory of the pitching arm and not the complete simulation and execution of the fundamentals of a pitch are seen in U.S. Pat. No. 4,846,471 to Haysom entitled "Method For Use In The Training And Warming-Up of Baseball Pitchers" and U.S. Pat. No. 4,974,836 to Hirsch entitled "Resistance Weight Kit".

Thus, there is a need and there has never been disclosed a baseball pitching training apparatus that effectively simulates and trains the fundamental mechanics of a complete pitch.

III. OBJECTS OF THE INVENTION

It is the primary object of the present invention to simulate proper pitching mechanics to effectively teach the fundamental techniques of various pitches. A related object of the present invention is to enable the pitcher to pitch at greater speeds with increased accuracy.

Another object of the present invention is to provide a pitching apparatus that is equally useful for both right and left handed pitchers. A related object of the present invention is to provide a pitching apparatus that is adjustable to train pitchers of various heights and weights.

Another object of the present invention is to provide a pitching apparatus that is light weight and portable.

Still another related object of the present invention is to provide a quality pitching apparatus that is inexpensive to manufacture.

Another object of the invention is to provide a pitching apparatus that is safe and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is a pitching apparatus that teaches the fundamental techniques of a desired pitch through the regulation and control of a control arm. The pitching apparatus consists of a mechanical box housing, a control arm and a control box housing. The pitching apparatus is supported by a plurality of legs. The mechanical box housing utilizes a vertical axis member, a collar with a cutout, and a latch to position the control arm into a locked position. A light emitting diode sensor and a solenoid coact to release the control arm from the locked position and position the control arm into a rest position. The control box housing supports a control panel and is used to regulate and control the mechanics of the mechanical box housing in accordance with the selected pitch that the pitcher would like to learn.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
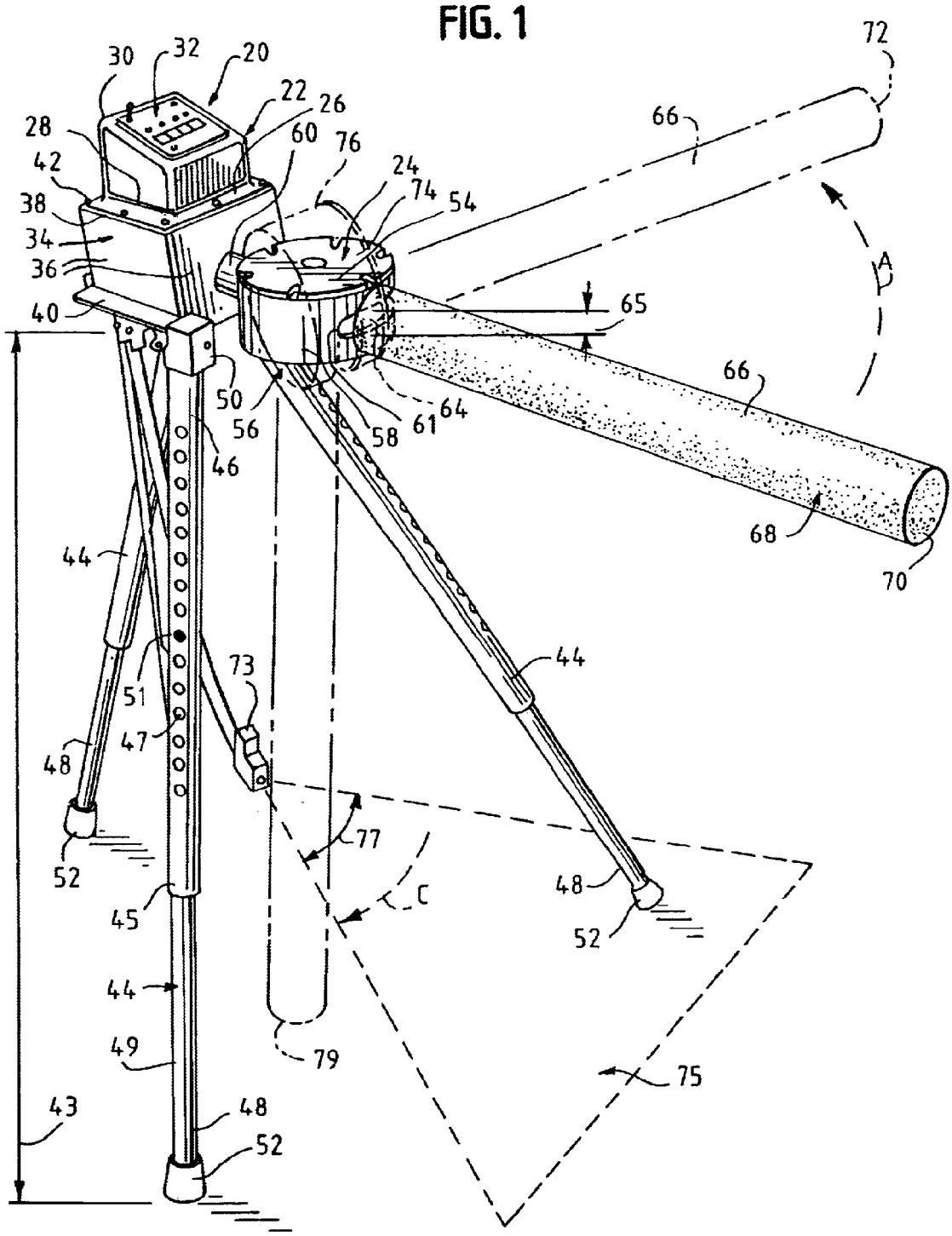
FIG. 1 is a perspective view of the pitching apparatus.

Turning first to FIG. 1, there is illustrated a pitching apparatus 20. The pitching apparatus 20 has a control box housing 22 and a mechanical box housing 24. The control box housing 22 is rectangular in shape with four sides 26, a bottom 28, and a top 30. Located on the top 30 of the control box housing 22 is a control panel 32. In the preferred embodiment, the top 30 is raised to a higher position along one side relative to the opposite side of the control box housing 22 such that the control panel 32 faces downward in the direction of the mechanical box housing 24. In this manner, the elevated control panel 32 is more accessible and more visible when in use by a pitcher.

The control box housing 22 is situated above the mechanical box housing 24 by a platform 34. The platform 34 is rectangular in shape with four sides 36, a top 38, and a base 40. The bottom 28 of the control box housing 22 is attached to the top 38 of the platform 34 by bolts 42 to secure the control box housing 22 to the platform 34. Alternatively, it is contemplated that any other means may be used to attach the control box housing 22 to the platform 34 provided that the control box housing 22 is sufficiently secured to the platform 34 to prevent independent movement of the control box housing 22 relative to the platform 34.

Supporting the control box housing 22 and the platform 34 are legs 44. In the preferred embodiment, the pitching apparatus 20 has at least three legs 44. Each of the legs 44 has a proximal end 46 and a distal end 48. The proximal end 46 of the legs 44 is attached to the base 40 of the platform 34 by a brace 50. The brace 50 enables each of the legs 44 to be rotated in an outward direction to position the legs 44 for optimum support of the pitching apparatus 20. The brace 50 also permits the legs 44 to be rotated in an inward direction to position the legs 44 for optimum storage when the pitching apparatus 20 is not in use. Alternatively, any other means to attach the end 46 of the legs 44 to the base 40 may be used provided that the legs 44 are sufficiently secured to the base 40 of the platform 34 and enable the legs 44 to be positioned for use and storage. At the distal end 48 of each of the legs 44 is affixed a foot 52. Preferably, the foot 52 is made of a rubber material. The foot 52 provides a friction surface to enable each of the legs 44 to remain in contact with the ground where positioned. The combination of the foot 52 and the brace 50 also coact to provide additional stability for each of the legs 44 and, thereby, sufficiently support the center of gravity of the pitching apparatus 20 while in use. Between the end 46 and the end 48 of each of the legs 44 is an exterior tube 45 with a plurality of holes 47. The plurality of holes 47 are positioned along the length of the exterior tube 45. The legs 44 also have an interior extension 49 with a retractable pin 51. The retractable pin 51 is positioned along the length of the interior extension 49 and in the same plane directly in line with the plurality of holes 47 on the exterior tube 45. Upon alignment of the retractable pin 51 with the desired hole 47, the retractable pin 51 extends outwardly from the interior extension 49 and projects through the hole 47 to prevent the interior extension 49 from extending any further from within the exterior tube 45 and, thereby, set a desired length 43 of the leg 44. For flat ground or horizontal surfaces, all of legs 44 are preferably set at the same length 43 for proper balance and stabilization of the pitching apparatus 20. Alternatively, depending upon the slope and grade of the pitchers mounds, it is contemplated that one or all of the legs 44 may be set at different lengths 43 to obtain proper balance and stabilization of the pitching apparatus 20.

The mechanical box housing 24 is circular in shape having a top surface 54, a bottom surface 56, and a side 58. The mechanical box housing 24 is attached to the platform 34 by a crossbar 60. The crossbar 60 extends outwardly from the side 58 of the mechanical box housing 24 directly to the side 36 of the platform 34 in which the control panel 32 faces. Alternatively, it is contemplated that the mechanical box housing 24 may be attached to either the platform 34 or the control box housing 22 and in any manner so long as the use that the mechanical box housing 24 serves is not disrupted.

Figure 5:
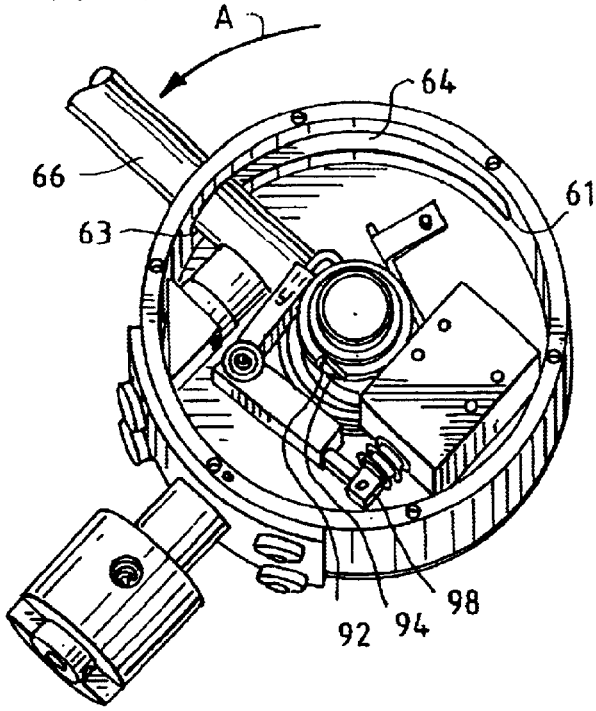
FIG. 5 is a top perspective view with portions removed of the mechanical box housing illustrating the control arm in the rest position and, in particular, depicting the cutout in the collar.

The side 58 of the mechanical box housing 24 has a slot 64. The slot 64 extends in an arc along the exterior circumference of the mechanical box housing 24. In the preferred embodiment, the extension of the arc is at least ninety degrees (90°). Alternatively, the extension of the arc may be greater than ninety degrees (90°) and less than three hundred and sixty degrees (360°). In the preferred embodiment, the slot 64 begins at beginning location 61 and continues along the arc of the exterior circumference of the mechanical box housing 24 until the slot 64 reaches ending location 63 (FIG. 5). The slot 64 has a slot width 65 which is less than the width of the side 58 of the mechanical box housing 24 and greater than the diameter of the control arm 66.

Extending perpendicular and outwardly from the mechanical box housing 24 and through the slot 64 is a control arm 66. The control arm 66 is preferably an elongated member that is cylindrical in shape. Alternatively, the control arm 66 may be any other elongated shape provided that the control arm 66 performs its intended use. In use, the control arm 66 rotates from a locked position 70, which is perpendicular to the mechanical box housing 24 and the control box housing 22 and at the beginning location 61 of slot 64, to a rest or idle position 72, which is parallel to the mechanical box housing 24 and the control box housing 22 and at the ending location 63 of the slot 64. In the preferred embodiment, the control arm 66 rotates along the slot 64 of the mechanical box housing 24 in the direction of arrow A through a ninety degree (90°) arc from the locked position 70 to the rest position 72. The structure and mechanics of the rotation of the control arm 66 are more fully discussed below. The control arm 66 is also wrapped in a foam cover 68. The foam cover 68 is used to protect the user from possible injury during the rotation of the control arm 66 from the locked position 70 to the rest position 72.

Figure 2:
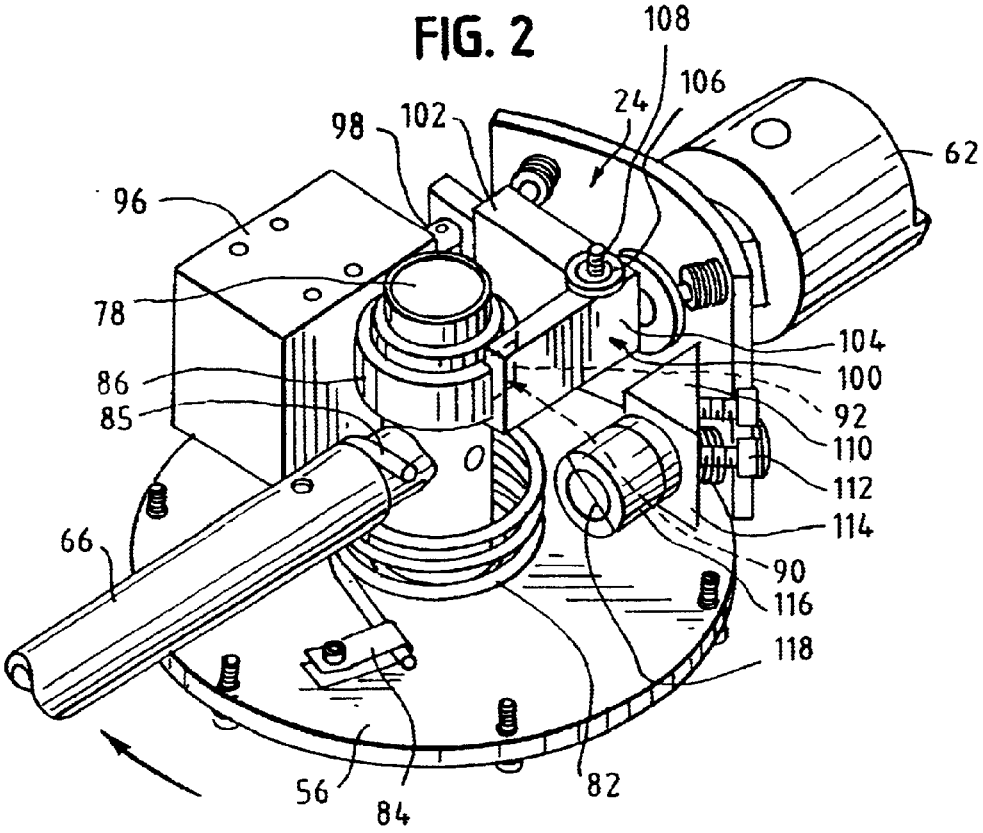
FIG. 2 is a perspective view with portions removed illustrating the components within the mechanical box with the control arm in the armed position.
Figure 3:
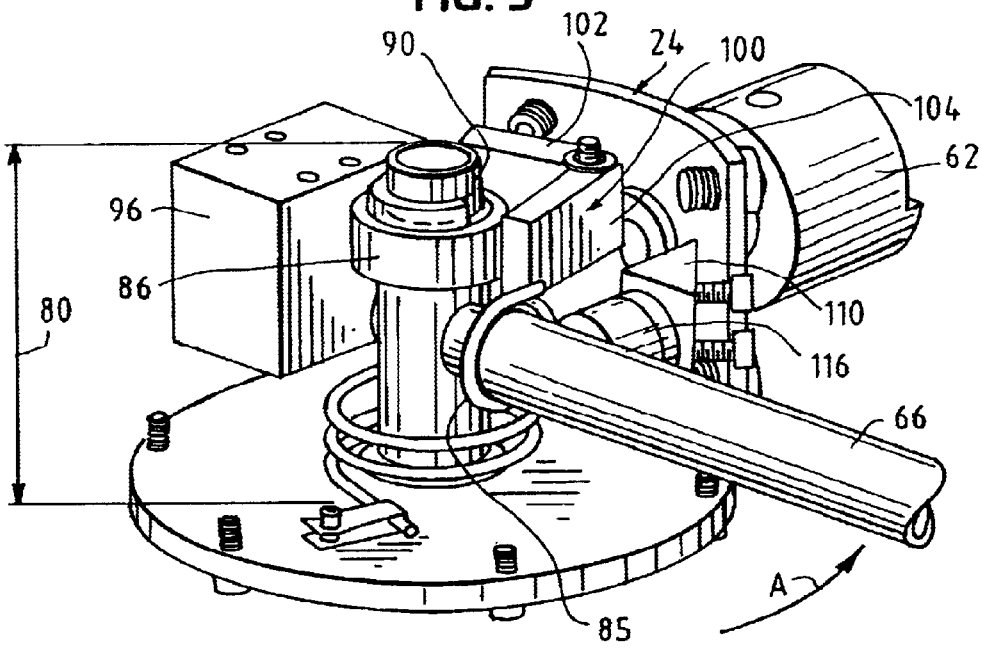
FIG. 3 is a perspective view with portions removed illustrating the components within the mechanical box with the control arm in the rest position.

Situated along the crossbar 60 between the side 36 of the platform 34 and the mechanical box housing 24 is a swivel mount 62 (FIG. 2). The swivel mount 62 enables the mechanical box housing 24 to be rotated in the direction of arrow B through ninety degrees (90°) from an engagement position 74 to a storage position 76. In the storage position 76, the control arm 66 will likewise rotate in the direction of arrow B through ninety degrees (90°) from the rest position 72 to a control arm storage position 79. With the legs 44 pulled inward under the platform 34, the pitching apparatus 20 becomes a compact unit that is easy to transport from one location to another for storage when not in use.

Extending outwardly from the platform 34 and control box housing 22 is a light emitting diode sensor 73. The light emitting diode sensor 73 is a standard light to voltage optical sensor that is used as a detector. The light emitting diode sensor 73 emits a series or constant stream of infrared pulses or coded signals. In the preferred embodiment, the sensor emits this light into a sensor area 75. The sensor 73 has an emitting angle 77 of approximately one hundred and fifty degrees (150°). The sensor 73 also has a measurement range that extends from the sensor 73 located, at some position between the legs 44 and below the platform 34, to, at least, the opposite end of the control arm 66. Preferably, the range is approximately four feet (4'). The combination of the emitting angle 77 and the measurement range forms the sensor area 75.

Turning to FIGS. 2–5, the structure and mechanics of the rotation of the control arm 66 within the mechanical box housing 24 are more fully illustrated. Situated in the center of the mechanical box housing 24 is a vertical axis member 78. The vertical axis member 78 has a length 80 (FIG. 3) and extends upwardly and perpendicular from the bottom surface 56 of the mechanical box housing 24 toward the top surface 54 of the mechanical box housing 24. Preferably, the vertical axis member 78 does not engage or contact the top surface 54 so as to prevent the top surface 54 from inhibiting the rotation of the vertical axis member 78. Situated around the lower exterior circumference of the vertical axis member 78 is a coiled spring 82. The coiled spring 82 has one end secured to the bottom surface 56 by a bracket 84. Alternatively, any other means to secure the coiled spring 82 to the bottom surface 56 may be used as long as it prevents the independent movement of the coiled spring 82 with respect to the vertical axis member 78 and the bottom surface 56. The coiled spring 82 is wrapped around the exterior circumference of the vertical axis member 78 in a number of coils and terminates in a hook 85. The hook 85 engages the control arm 66 adjacent to the vertical axis member 78.

Figure 4:
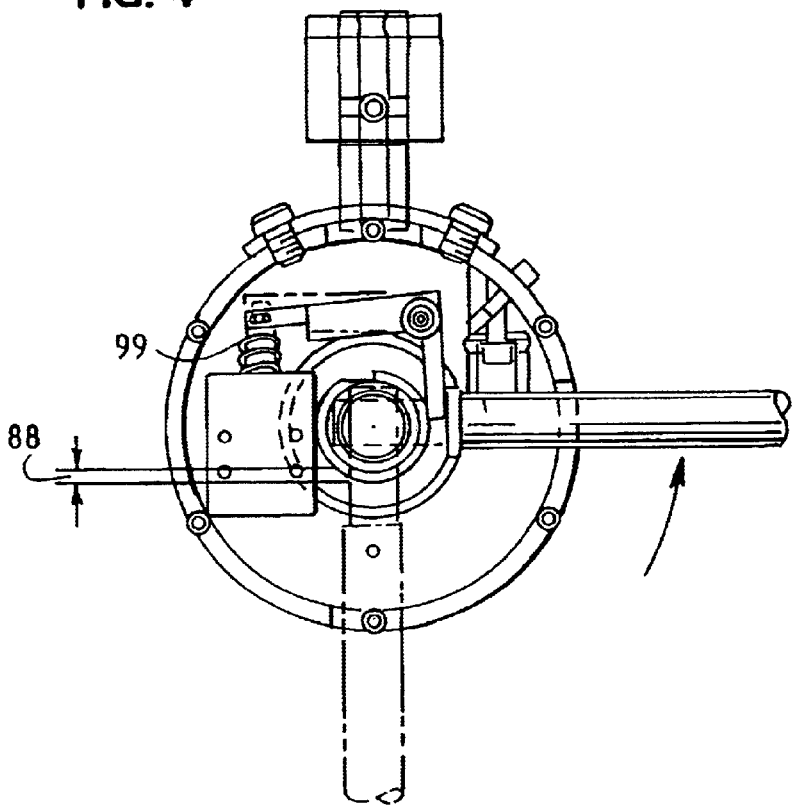
FIG. 4 is a top plan view with portions removed illustrating the components of the mechanical box housing.

The vertical axis member 78 also has a collar 86. The collar 86 is circular in shape and is affixed along the top exterior circumference of the vertical axis member 78. The collar 86 has a thickness 88 (FIG. 4). Within the thickness 88 and circular shape of the collar 86 is a cutout 90. The cutout 90 is formed by a ledge 92 (FIG. 5) and a sidewall 94 (FIG. 5). Extending outwardly and perpendicular from the vertical axis member 78 and remaining parallel to the bottom surface 56 of the mechanical box housing 24 is the control arm 66.

Located adjacent to the vertical axis member 78 and attached to the bottom surface 56 of the mechanical box housing 24 is a solenoid 96. In the preferred embodiment, the solenoid 96 is located in any position that is not between the locked position 70 and the rest position 72 of the control arm 66.

The solenoid 96 is a conventional solenoid available in the marketplace today. The solenoid 96 is comprised of an electromagnet encased within an iron or steel container. Situated at one end of the iron or steel container is a release arm 98, commonly referred to as a "T" plunger. The release arm 98 is positioned in the center of the electromagnet. As current flows through the electromagnet the release arm 98 is pulled into the container. Located around the release arm 98 is a detent spring 99 (FIG. 4). When the current is shut off or no longer applied, the detent spring 99 expands to push the release arm 98 back out from the solenoid 96.

Attached to the release arm 98 is a latch 100. The latch 100 is an "L" shaped member with a base arm 102 and a locking arm 104. Preferably, the base arm 102 and the locking arm 104 remain perpendicular to each other and rotate about a pivot point 106 which is affixed to the top surface 54 of the mechanical box housing 24 by a screw 108. In the preferred embodiment, the screw 108 coacts to support the latch 100 in position for proper use while permitting the latch 100 to rotate about the pivot point 106. Alternatively, any other means to support the latch 100 may be used provided that the latch 100 remains in position and is capable to rotate for its intended purpose to lock and release the control arm 66.

Situated along the interior of side 58 of the mechanical box housing 24 is a wedge support 110. The wedge support 110 is affixed to the side 58 by bolts 112. Alternatively, it is contemplated that any other means to affix the wedge support 110 to the side 58 is sufficient so long as the wedge support 110 maintains the proper affixed position. The wedge support 110 is shaped in the form of a triangle with three sides 114. One of the three sides 114 is affixed to the side 58 of the mechanical box housing 24 and the second of the three sides 114 supports a stop 116. Alternatively, the wedge support 110 may be any other shape provided the wedge support 110 is sufficiently secured to the side 58 of the mechanical box housing 24 and provides adequate support for the stop 116. Likewise, the stop 116 is circular in shape but may be any other contemplated shape. The stop 116 has a diameter 118. Preferably, the diameter 118 is approximately equal to the diameter of the control arm 66.

Figure 6:
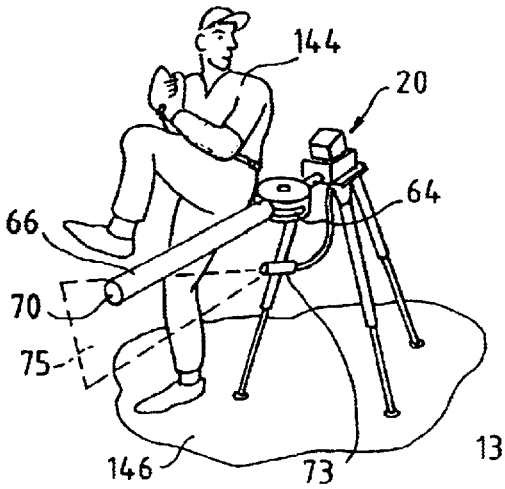
FIG. 6 is a perspective view of the pitching apparatus with the control arm in the armed position relative to the pitcher.
Figure 7:
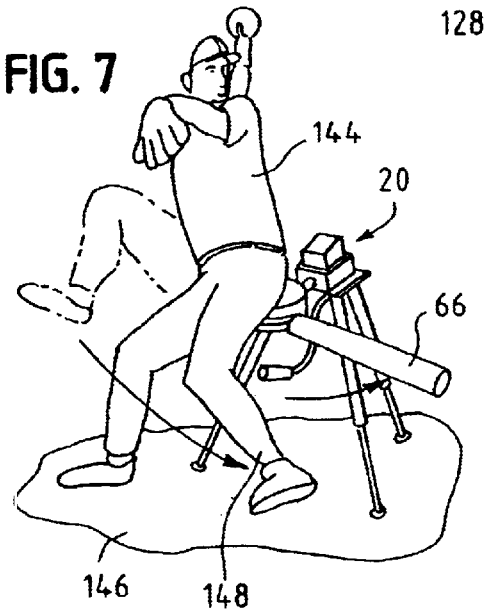
FIG. 7 is a perspective view of the pitching apparatus with the control arm in the release position relative to the movement of the pitcher.
Figure 8:
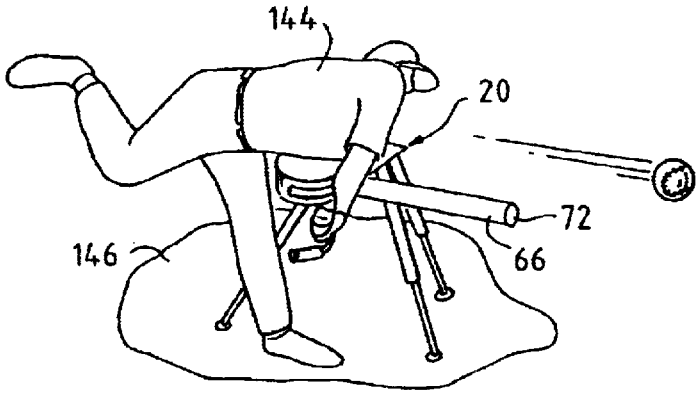
FIG. 8 is a perspective view of the pitching apparatus with the control arm in the rest position relative to the final position of the pitcher.

Turning to FIGS. 6–8, an example of the pitching apparatus 20 as used by a pitcher is shown. In use, the control arm 66 is manually rotated clockwise along the slot 64 of the mechanical box housing 24 through a ninety degree (90°) arc from the rest position 72 (FIG. 1) to the locked position 70. As the control arm 66 is rotated in this direction, the coiled spring 82 is wound around the vertical axis member 78 creating a stored energy or tension in the coiled spring 82 that is exerted against the control arm 66 and increased to higher strength when the control arm 66 reaches the locked position 70. The control arm 66 is maintained in the locked position 70 by the combination of the collar 86 and the latch 100. More specifically, as the control arm 66 rotates from the rest position 72 to the locked position 70, the vertical axis member 78 is likewise rotated clockwise through the same ninety degree (90°) arc. Upon the control arm 66 reaching the locked position 70, the locking arm 104 of the latch 100 engages the cutout 90 in the collar 86 to prevent the vertical axis member 78 from rotating counter clockwise back to the rest position 72 due to the counter forces exerted by the coiled spring 82. Upon the control arm 66 reaching the locked position 70 and the pitching apparatus being activated, the light emitting diode sensor 73 begins to emit its series or constant stream of infrared or coded signals into the sensor area 75. At this moment, the pitching apparatus 20 is ready for use by a pitcher 144 located on a mound 146 as illustrated in FIG. 6.

As the pitcher 144 executes the proper mechanics of the desired pitch as discussed below, the front leg 148 of the pitcher 144 enters the sensor area 75 as illustrated in FIG. 7. When the front leg 148 enters the sensor area 75, the infrared pulses or coded signals are reflected back to the light emitting diode sensor 73. The light emitting diode sensor 73 receives the pulses or coded signals and sends a signal to the control circuit on the circuit board as illustrated by the electrical schematic of FIG. 10. The control circuit energizes the solenoid 96 to pull the release arm 98 into the solenoid 96. As the release arm 98 is pulled into the solenoid 96, the base arm 102 is likewise pulled toward the solenoid 96 which effectively rotates the latch 100 about the pivot point 106 and disengages the locking arm 104 from the cutout 90 of the collar 86. Once the latch 100 is released from the vertical axis member 78, the tension of the coiled spring 82 is released and the hook 85 forces the control arm 66 from the locked position 70 through the arc of the slot 64 to the rest position 72. If, however, the pitcher 144 does not execute the proper fundamental techniques of the pitch, the front leg 148 will not accurately enter the sensor area 75 and the control arm 66 will not be released to permit the pitcher 144 to complete the pitch.

With the release of the control arm 66, the pitcher 144 is permitted to complete the desired pitch as illustrated in FIG. 8 as the control arm 66 completes the rotation into the rest position 72. As the control arm 66 reaches the rest position 72, the stop 116 and the ending location 63 of the slot 64 coact to stop the rotation of the control arm 66 and position the control arm 66 into the rest position 72. The legs 44 stabilize the pitching apparatus 20 and absorb the energy and forces released during the pitching process to maintain the pitching apparatus 20 in proper position to teach the fundamental techniques of the desired pitch.

Figure 9:
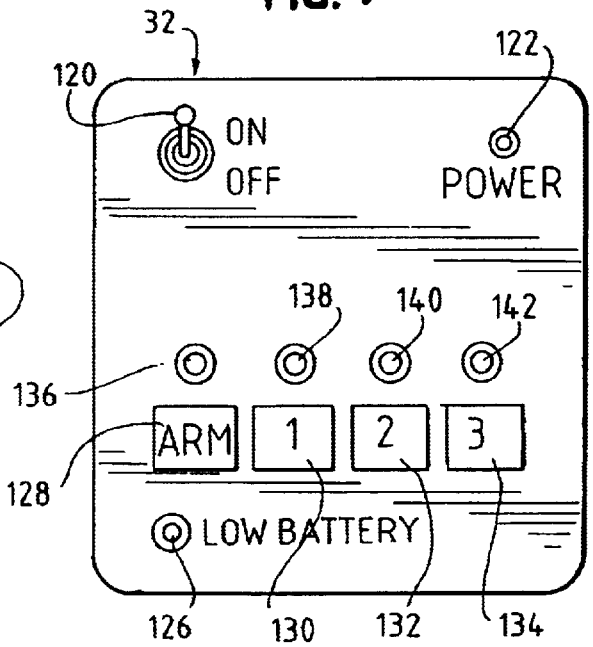
FIG. 9 is a top plan view of the control box housing illustrating the control buttons of the pitching apparatus.

Turning to FIG. 9, the control panel 32 of the pitching apparatus 20 is more clearly illustrated. The control panel 32 controls the operation of the pitching apparatus 20 to teach a number of different pitches. The control panel 32 consists of an on/off switch 120 and a power light display 122. When the on/off switch is toggled to the "on" position, the flow of electricity from a power source 124 (not illustrated) will energize the pitching apparatus 20 for use. Preferably, the power source 124 is a battery. Alternatively, the power source 124 may be any other means to energize the pitching apparatus 20. The power light display 122 will engage and display a color, such as red, to indicate that the pitching apparatus 20 is energized by the power source 124. If the power source 124 becomes low on energy, a low battery light display 126 will energize and display a color, such as red, to indicate a low power source 124 and that the pitching apparatus 20 may not have enough power to continue in operation for the remainder of the training session.

Alternatively, the pitching apparatus 20 may be completely functional and operable without the control panel 32 except that: (1) the number of different pitching techniques would be limited to one, and (2) the pitching apparatus 20 would not provide the same safety precautions related to the control arm 66 that are provided by the control panel 32.

The control panel 32 comprises a number of buttons that control the engagement and release of the pitching apparatus 20, specifically the control arm 66. These buttons are an arm button 128, a wind-up button 130, a stretch button 132, and an updownout button 134. With each button, the control panel comprises a corresponding light display to signal to the user which buttons have been activated and are engaged. These light display buttons are an arm display light 136, a wind-up display light 138, a stretch display light 140, and a updownout display light 142.

The arm button 128 controls the engagement or locking of the control arm 66. When a user desires to simply engage the pitching apparatus 20, the user will rotate the control arm 66 from the rest position 72 to the engagement position 74. In the engagement position 74, the control arm 66 will not release until the pitching apparatus 20 is activated. To activate the pitching apparatus 20, the user must then depress the arm button 128. At this point the pitching apparatus 20 is activated and will be released if the sensor 73 is triggered or, in other words, the pitcher contacts the sensor area 75.

The pitching apparatus 20 may be programmed to teach different types of pitches to the pitcher. These are the wind up pitch, the stretch pitch, and the up down out pitch. The procedure for each of these pitches is basically the same.

The proper pitching mechanics that a pitcher goes through from start to finish are illustrated by the same six steps. If any of these steps are done incorrectly it can cause a total "breakdown" of the mechanical process possibly causing inaccurate pitches, lower velocity, and extra stress to the body, which can ultimately lead to injury.

The first step is the Rocker Step. The pitcher adjusts the height of the pitching apparatus to the proper settings for that particular pitcher. The pitcher's stance should be relaxed with the pitcher's focus on a small detailed part of the target over home base. The pitcher then takes a small step to the side of the pitching rubber, preferably not behind. The reason is that if the step is to the side of the pitching rubber there is no dramatic weight shift of the body. Also, with the leg of the pitching apparatus to the side of the pitcher it prevents the pitcher from taking too big of a rocker step as well.

Second step, the pitcher will pick his or her front leg up, while the weight of the pitcher is balanced on the "balls" of his or her plant foot. Preferably, the pitcher should not swing the leg up to the balance position so that the pitcher remains in control of his or her actions. If the pitcher swings his or her leg up, it can create two problems: (a) by swinging the leg up the shoulders of the pitcher have a tendency to fall backwards which will place the pitcher in a less than ideal throwing position; and (b) by swinging the leg up the weight of the pitcher does not remain on the balls of the pitcher's feet and, thereby, once again place the pitcher in a less than ideal throwing position. During this step, the position of the control bar of the pitching apparatus forces the pitcher to pick his or her leg up in a controlled and ideal position.

Third step, the balance position. If the first two steps were done properly, the pitcher will be in the ideal balance position. This step is crucial because, if the pitcher does not obtain the ideal balance position, the odds of a success pitch decreases dramatically and the odds of injury increases dramatically. The ideal balance position involves having the back leg slightly flexed and the front leg bent in a ninety (90)

degree angle. The arms are placed at the center of the chest and the pitcher's weight is on the balls of the pitcher's foot.

Fourth step, the pitcher is to break the hands and lead with the front foot. The hands are broken to get the arm started before the body. Nearly a split second after the pitcher breaks the hands, the pitcher will lead with his or her front foot down and out towards home plate. During this lead with the front foot, however, the pitcher will remain balanced with the pitcher's weight remaining back. This may very well be the most important step in order to achieve success and avoid injury. During this step, the pitching apparatus forces the weight of the pitcher to remain back and keep a proper balanced position. Once the front leg is extend into the sensor area to trigger the sensor, the control arm will be released to allow the pitcher to execute the remaining steps.

Fifth step, the throwing position. At this point the pitcher's weight is predominately still back. The throwing elbow is up and in the L-position, the thumbs are down, and the fingers are facing away from the pitcher. The pitcher's feet are little over shoulder-width apart and the front foot is just slightly closed. It is now that the weight of the pitcher begins to shift forward and the torso twist for the pitcher to generate maximum power.

Six and final step, the pitcher follows through to complete the pitching process. Once the ball has been released, the pitcher's back heel will go to the sky and all the pitcher's momentum will go towards home plate. This is necessary because it puts the pitcher in a position with all their power being exerted towards the target at home plate and places the pitcher in the ideal fielding position. During this step, the pitching apparatus forces the pitcher to execute the correct follow through due to the control bar rotating through the ninety (90) degree arc angle and prohibiting the pitcher from "falling of the mound."

During each of these six step procedure from the wind up pitch, the stretch pitch, and the up down out pitch, the pitcher may contact the sensor area 75 more than once before the pitcher is ready to release. In these instances, the pitching apparatus 20 must be programmed to account for the different styles of pitches and the additional contacts to the sensor area 75.

In the wind up pitch, the pitcher 144 should only contact the sensor area 75 once during the fourth step when the pitcher leads with the front leg. To teach this pitch, the user must program the pitching apparatus 20 accordingly. To program this wind up pitch, the user must: (1) rotate the control arm 66 from the rest position 72 to the engagement position 74; (2) depress the wind-up button 130 which will also simultaneously activate the wind-up display light 138; (3) depress the arm button 128 to activate the sensor 73 which will also simultaneously activate the arm display light 136; and (4) perform the wind up pitch, in which case, the sensor 73 will release the control arm 66 on the first instance that the pitcher contacts the sensor area 75.

In the stretch pitch, the pitcher 144 should contact the sensor area 75 twice: the first time as the pitcher comes set to take his stance since, for this pitch, the pitcher is facing more toward first base; and the second time when the pitcher executes the fourth step by leading with the front leg. To teach this pitch, the user must program the pitching apparatus 20 by: (1) rotating the control arm 66 from the rest position 72 to the engagement position 74; (2) depressing the stretch button 132 which will also simultaneously activate the stretch display light 140; (3) depress the arm button 128 to activate the sensor 73 which will also simultaneously activate the arm display light 136; and (4) perform the stretch pitch, in which case, the sensor 73 will release the control arm 66 on the second instance that the pitcher contacts the sensor area 75.

In the up down out pitch, the pitcher 144 should contact the sensor area 75 at least three times: the first and second time occurs as the pitcher simulates the fourth step two times as a drill to concentrate on proper balance positioning and then, the third time, the pitcher 144 actually completes the fourth step in which instance the control arm 66 is to be released. To teach this pitch, the user must program the pitching apparatus 20 by: (1) rotating the control arm 66 from the rest position 72 to the engagement position 74; (2) depressing the updownout button 134 which will also simultaneously activate the updownout display light button 142; (3) depress the arm button 128 to activate the sensor 73 which will also simultaneously activate the arm display light 136; and (4) perform the up down out pitch, in which case, the sensor 73 will release the control arm 66 on the third instance that the pitcher contacts the sensor area 75. Alternatively, the pitching apparatus 20 may be programmed to account for any number of different style pitches and contacts to the sensor area 75 to teach a pitcher.

Figures 10, 10A, 10B:
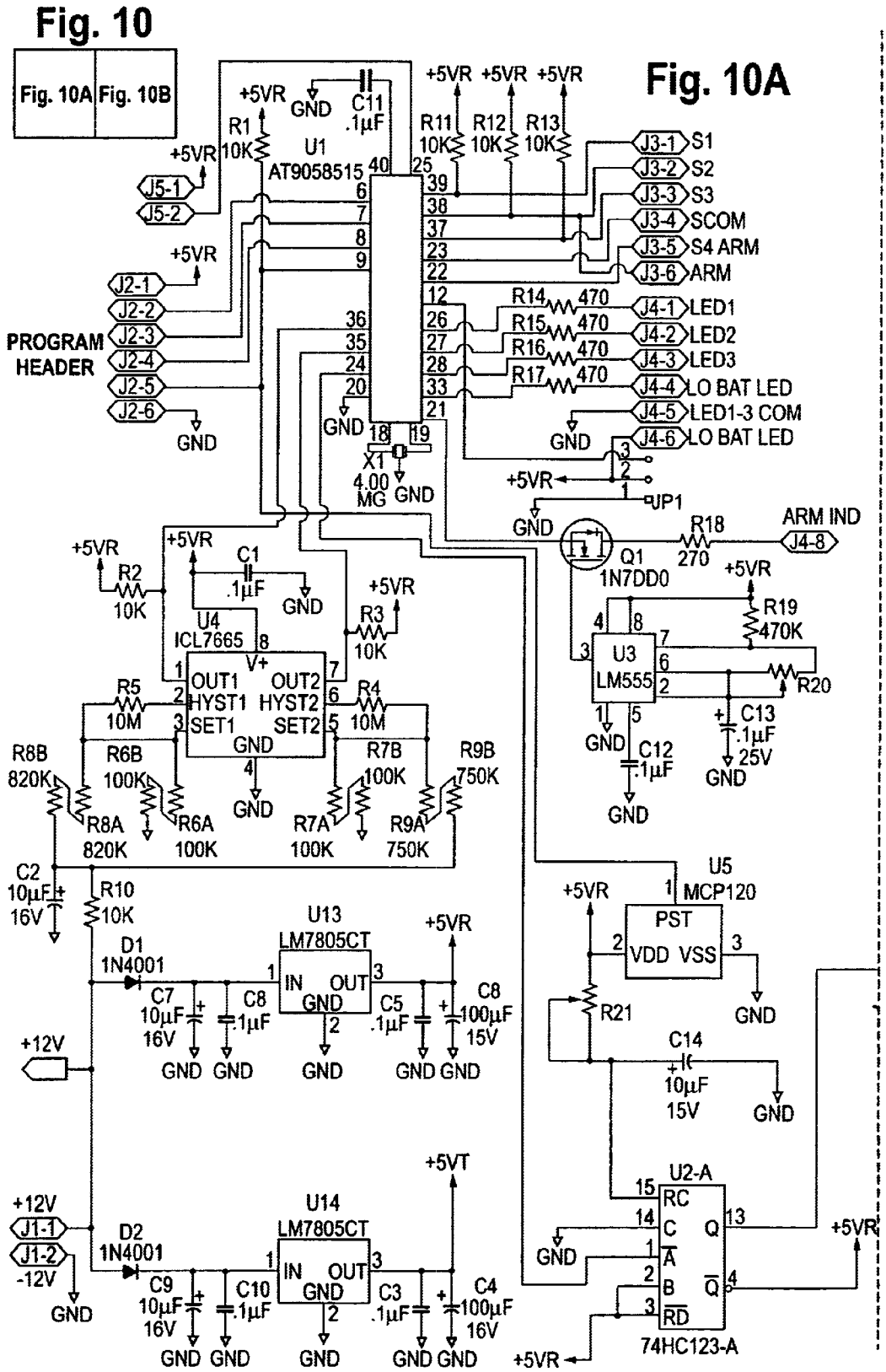
FIG. 10 is an electrical schematic diagram of the pitching apparatus used to operate the control arm with respect to the various pitching techniques.
Figure 10B:
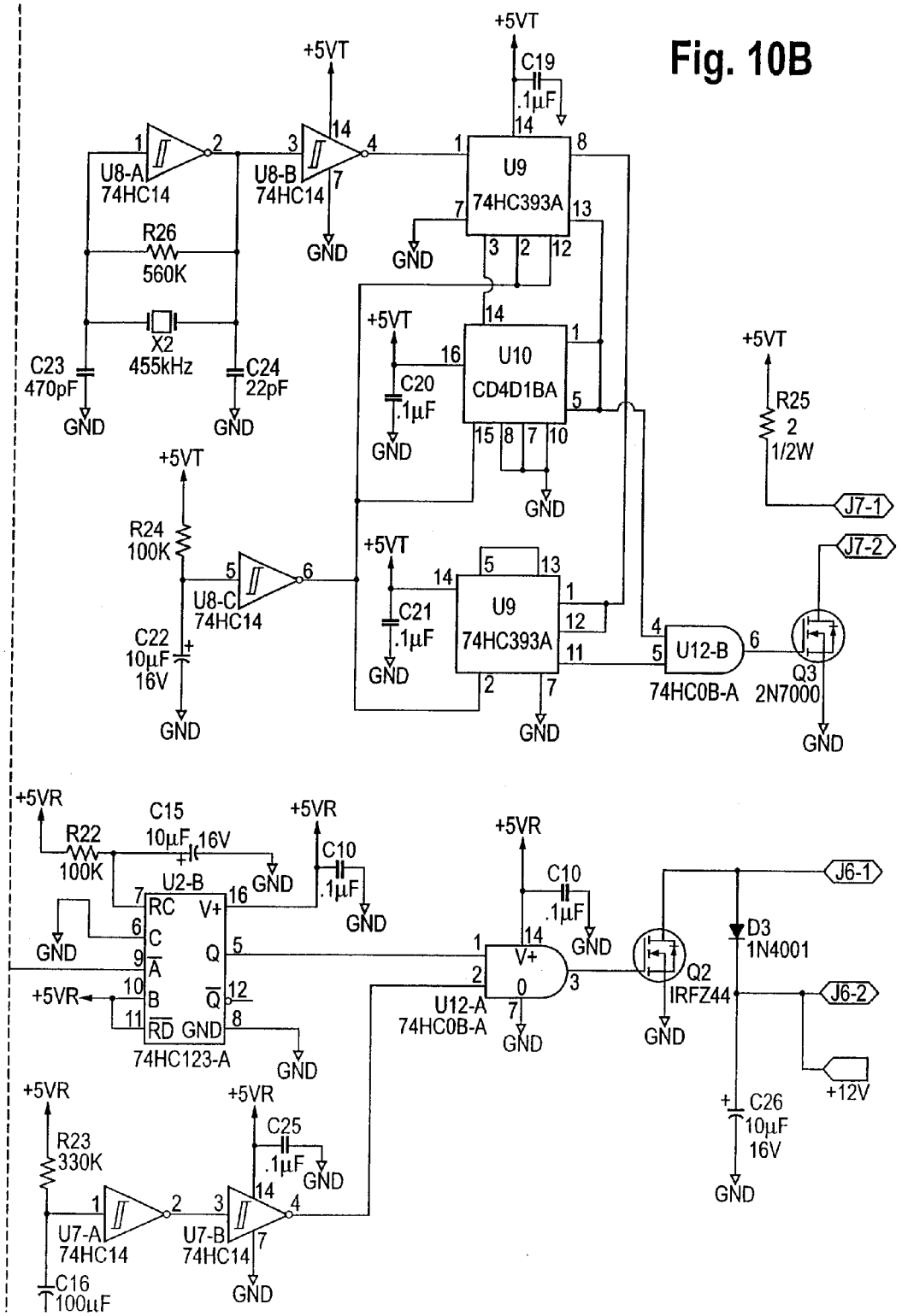

FIG. 10 is an electrical schematic diagram illustrating the electronics of the operation of the pitching apparatus 20 and, in particular, the use of the buttons of the control panel 32 to select the desired pitch, the light emitting diode sensor 73 to receive the desired pitch information from the control panel 32, regulate and determine the release of the control arm 66 with respect to the desired pitch and send a signal to activate the solenoid 96 for the release of the control arm 66 to teach the proper fundamentals of that desired pitch.

In accordance with the electrical schematic, the operation of the pitching apparatus 20 is as follows. The electrical circuitry and firmware is controlled and regulated by a microprocessor designated by U1. Preferably, the microprocessor is an Atmel Corporation, Part No.: AT905815754PC. This microprocessor receives inputs from J3-1, J3-2, and J3-3 which represents the wind-up button 130, the stretch button 132, and the updownout button 134, respectively. The J3-5 input represents the arm button 128. Depending upon which input is received from the J3 inputs, the microprocessor sends an output signal to energize the appropriate light display. If the wind-up button 130 (J3-1) is selected, the wind-up light display represented by J4-1 is energized; if the stretch button 132 (J3-2) is selected, the stretch light display 140 represented by J4-2 is energized; if the updownout button 134 is selected, the updownout light display 142 represented by J4-3 is energized. When the arm button 128 is activated after the selected pitch designation, the arm light display 126 represented by J4-8 is energized to indicate that the pitching apparatus 20 is armed and ready for use.

Once the desired pitch is selected and the pitching apparatus 20 is ready for use, the microprocessor sends a signal to a circuit, represented by U8–U12, to transmit the infrared pulses or coded signals through the light emitting diode sensor 73, represented by J7-1 and J7-2. Every time the pitcher engages the sensor area 75, the reflected infrared or coded signal is received by the light emitting diode sensor 73 at JP1 and then forwarded to the microprocessor at U1, 12, to be analyzed. If the wind-up pitch is selected, then the first instance of the pitcher contacting the sensor area 75 releases the control arm 66. This occurs, when the microprocessor receives and determines that the reflected signal is in fact the appropriate reflection from the pitcher contacting the sensor area 75. The microprocessor sends an output signal through U1, 24. The signal is then "conditioned" at "buffering circuit" represented by U2-A and sent to the U2-B circuit to receive any delay instructions. Preferably, U2-B is set at zero, in which case the Q2 transistor is immediately fired activating the solenoid 96 and initiating the releasing means to release the control arm 66 from the locked position 70 to the rest position 72. Alternatively, the U2-B circuit may be programmed with a delay sequence. In other words, once the signal is received to initiate the activation of the solenoid 96, the U2-B circuit may be programmed with a timed delay, in which case, the solenoid 96 will not be activated until after the delay is completed. For example, if the pitcher desired to hold the control arm 66 in the locked position 70 for an additional three seconds after the sensor area 75 had been engaged by the pitcher, the U2-B can be programmed with a three second time delay to prevent the solenoid 96 from activating for those three seconds and, thereby, prevent the control arm 66 from moving from the locked position 70 for three seconds following the triggering engagement of the sensor area 75. If the stretch or updownout pitches are selected, the microprocessor will receive the reflected signal into a counting registry. Once the proper number of engagements with the sensor area 75 are contacted by the pitcher, the microprocessor will then send the signal to activate the solenoid 96 as previously discussed. The entire operation of the pitching apparatus 20 is powered by a power source 124. As the power source 124 is preferably a twelve (12) voltage battery, the pitching apparatus 20 is reduced to operate on five (5) volts, as represented by U13 and U14, to create a safe margin for operation and maximize the operation performance.

Thus, there has been provided a pitching apparatus that uses the combination of unique mechanics and electronics to properly teach the fundamental techniques of pitching. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. An apparatus for teaching a pitcher the fundamental techniques of a baseball pitch, comprising:

selection means for selecting a plurality of pitches;

a control arm that is selectively moved to a first armed position from a second, at rest, position;

force applying means for urging the control arm from the first armed position to the second, at rest, position;

locking means for selectively retaining the control arm in the first armed position;

lock releasing means for releasing the locking means to allow the control arm to move from the first armed position to the second, at rest, position;

control means for recognizing the plurality of pitches selected and controlling the lock releasing means for each of the plurality of pitches selected; and means for supporting the pitching apparatus during operation.

2. The apparatus of claim 1 and further comprising a sensor that transmits a signal to the control means when a user of the pitching apparatus is properly oriented during at least a portion of delivering the baseball pitch.

3. The apparatus of claim 2 wherein the sensor provides a zone which when penetrated by the user sends the signal to the control means.

4. The apparatus of claim 1 wherein the selection means for selecting a plurality of pitches comprises a control box panel that provides a plurality of buttons to select any of the plurality of pitches, each of the buttons representing a different pitch, whereby upon the depression of any one of the plurality of buttons the selected pitch is programmed into the pitching apparatus.

5. The apparatus of claim 1 wherein the force applying means is a spring.

6. The apparatus of claim 1 wherein the locking means for selectively retaining the control arm in the first armed position comprises a vertical axis member having a cutout, the control arm affixed to and extending outwardly from the vertical axis member, a latch having a base arm and a locking arm, the locking arm of the latch engaging the cutout of the vertical axis member upon the control arm being rotated clockwise through an arc angle from the second, at rest, position to the first armed position, the latch and the vertical axis member coacting for preventing the control arm from returning to the second, at rest, position.

7. The apparatus of claim 6 wherein the arc angle is approximately ninety degrees.

8. The apparatus of claim 3 wherein the lock releasing means for releasing the locking means comprises a solenoid having a release arm operatively connected to the locking means, the control means receiving the signal from the sensor and activating the solenoid to release the locking means for allowing the control arm to move from the first armed position to the second, at rest, position.

9. The apparatus of claim 1 wherein the control means for recognizing the plurality of pitches selected and controlling the lock releasing means for each of the plurality of pitches selected is a microprocessor.

10. An apparatus for teaching a pitcher the fundamental techniques of a baseball pitch, comprising:

a control arm that is selectively moved to a first armed position from a second, at rest position;

force applying means for urging the control arm from the first armed position to the second, at rest, position;

locking means for selectively retaining the control arm in the first armed position;

lock releasing means for releasing the locking means to allow the control arm to move from the first armed position to the second, at rest, position;

a control box panel that provides a plurality of buttons to select any of the plurality of pitches, each of the buttons representing a different pitch, whereby upon the depression of any one of the plurality of buttons the selected pitch is programmed into the pitching apparatus.

11. The apparatus of claim 10 and further comprising a control means for recognizing the plurality of pitches selected and controlling the lock releasing means for each of the plurality of pitches selected.

12. The apparatus of claim 10 and further comprising means for supporting the pitching apparatus during operation.

13. The apparatus of claim 11 and further comprising a sensor that transmits a signal to the control means when a user of the pitching apparatus is properly oriented during at least a portion of delivering the baseball pitch.

14. The apparatus of claim 13 wherein the sensor provides a zone which when penetrated by the user sends the signal to the control means.

15. The apparatus of claim 10 wherein the locking means for selectively retaining the control arm in the first armed position comprises a vertical axis member having a cutout, the control arm affixed to and extending outwardly from the vertical axis member, a latch having a base arm and a locking arm, the locking arm of the latch engaging the cutout of the vertical axis member upon the control arm being rotated clockwise through an arc angle from the second, at rest, position to the first armed position, the latch and the vertical axis member coacting for preventing the control arm from returning to the second, at rest, position.

16. The apparatus of claim 13 wherein the lock releasing means for releasing the locking means comprises a solenoid having a release arm operatively connected to the locking means, the control means receiving the signal from the sensor and activating the solenoid to release the locking means for allowing the control arm to move from the first armed position to the second, at rest, position.

17. A method for using an apparatus for teaching a pitcher the fundamental techniques of a baseball pitch, comprising the steps of:

providing a pitching apparatus consisting of a control box panel having a plurality of buttons for selecting any of a plurality of pitches, each of the buttons representing a different pitch, whereby upon the depression of any one of the plurality of buttons the selected pitch is programmed into the pitching apparatus;

moving a control arm to a first armed position from a second, at rest, position;

applying a force to the control arm for urging the control arm from the first armed position to the second, at rest, position by providing a spring for exerting force on the control arm toward the second, at rest, position;

retaining the control arm in the first armed position by providing a vertical axis member having a cutout, the control arm extending outwardly from the vertical axis member, a latch having a base arm and a locking arm, the locking arm of the latch engaging the cutout of the vertical axis member upon the control arm being rotated through an arc angle from the second, at rest, position to the first armed position, the latch and the vertical axis member coacting for preventing the control arm from returning to the second, at rest, position;

recognizing the plurality of pitches selected and controlling the releasing of the control arm for each of the plurality of pitches selected by providing a microprocessor;

releasing the control arm and allowing the control arm to move from the first armed position to the second, at rest, position, by providing a sensor that transmits a reflected signal to the microprocessor when a user of the pitching apparatus penetrates a zone during at least a portion of delivering the baseball pitch, the microprocessor receiving the reflected signal and activating a solenoid, the solenoid having a release arm affixed to the base arm of the latch, the solenoid pulling the release arm and the base arm towards the solenoid for rotating the locking arm of the latch in an outwardly direction from the cutout for permitting the control arm to rotate from the first armed position to the second, at rest, position; and supporting the pitching apparatus during operation.

* * * * *

UNITED STATES PATENT AND TRADEMARK OFFICE

CERTIFICATE OF CORRECTION

PATENT NO. : 6,663,512 B2
DATED : December 16, 2003
INVENTOR(S) : Jeffrey M. Martin It is certified that error appears in the above-identified patent and that said Letters Patent is hereby corrected as shown below:

Drawings,
"Sheet 1 of 5" is incorrect, correct to -- Sheet 1 of 6 --
"Sheet 2 of 5" is incorrect, correct to -- Sheet 2 of 6 --
"Sheet 3 of 5" is incorrect, correct to -- Sheet 3 of 6 --
"Sheet 4 of 5" is incorrect, correct to -- Sheet 4 of 6 --
"Sheet 5 of 5" is incorrect, correct to -- Sheet 5 of 6 --
Sheet 6 of 6 is missing, correct to include attached copy of Sheet 6 of 6, Figure 10B.

Signed and Sealed this

Twenty-third Day of March, 2004

JON W. DUDAS
*Acting Director of the United States Patent and Trademark Office*

+5VT
C19
.1µF
U8-A
74HC14
U8-B
74HC14
U9
74HC393A
R26
560K
X2
455kHz
C23
470pF
C24
22pF
GND
U10
CD4D1BA
C20
.1µF
R25
2
1/2W
J7-1
J7-2
R24
100K
U8-C
74HC14
C22
10µF
16V
C21
.1µF
U12-B
74HC0B-A
Q3
2N7000
+5VR
R22
100K
C15
10µF 16V
U2-B
RC
V+
C
Q
A
B
RD
74HC123-A
C10
.1µF
U12-A
74HC0B-A
Q2
IRFZ44
D3
1N4001
J6-1
J6-2
+12V
C26
10µF
16V
R23
330K
U7-A
74HC14
U7-B
74HC14
C25
.1µF
C16
100µF